US008858368B2

(12) United States Patent
Clark

(10) Patent No.: US 8,858,368 B2
(45) Date of Patent: Oct. 14, 2014

(54) HANDHELD PERFORMANCE TRACKING AND MAPPING DEVICE UTILIZING AN OPTICAL SCANNER

(76) Inventor: John Clark, Ft. Mitchell, AL (US)

( * ) Notice: Subject to any disclaimer, the term of this patent is extended or adjusted under 35 U.S.C. 154(b) by 0 days.

(21) Appl. No.: 13/558,451

(22) Filed: Jul. 26, 2012

(65) Prior Publication Data

US 2013/0029790 A1 Jan. 31, 2013

Related U.S. Application Data

(60) Provisional application No. 61/513,252, filed on Jul. 29, 2011.

(51) Int. Cl.

| | |
|---|---|
| ***G06F 17/00*** | (2006.01) |
| ***A63B 71/06*** | (2006.01) |
| *A63B 24/00* | (2006.01) |
| *A63B 57/00* | (2006.01) |
| *A63B 69/36* | (2006.01) |

(52) U.S. Cl.

CPC ..... *A63B 71/0669* (2013.01); *A63B 2024/0068* (2013.01); *A63B 24/0062* (2013.01); *A63B 57/00* (2013.01); *A63B 2069/3605* (2013.01); *A63B 2220/12* (2013.01); *A63B 2220/805* (2013.01); *A63B 2071/0691* (2013.01)

USPC ..... 473/407; 701/208; 701/213; 701/214; 701/300; 395/133; 395/773; 395/779

(58) Field of Classification Search

USPC ..... 701/208, 213, 214, 300; 473/407; 345/764; 395/133, 779

See application file for complete search history.

(56) References Cited

U.S. PATENT DOCUMENTS

| | | | | |
|---|---|---|---|---|
| 4,815,020 | A | 3/1989 | Cormier | |
| 4,910,677 | A | 3/1990 | Remedio | |
| 5,245,537 | A | 9/1993 | Barber | |
| 5,507,485 | A | 4/1996 | Fisher | |
| 6,263,279 | B1 * | 7/2001 | Bianco et al. | 701/450 |
| 6,456,938 | B1 * | 9/2002 | Barnard | 701/454 |
| 2002/0027524 | A1 * | 3/2002 | Pippin | 342/357.08 |
| 2002/0072815 | A1 * | 6/2002 | McDonough et al. | 700/92 |
| 2002/0082775 | A1 * | 6/2002 | Meadows et al. | 701/214 |
| 2002/0177494 | A1 | 11/2002 | Kersten | |
| 2007/0016438 | A1 * | 1/2007 | Bain | 705/1 |
| 2008/0092202 | A1 * | 4/2008 | Greenquist et al. | 725/135 |

* cited by examiner

*Primary Examiner* — Sunit Pandya

(74) *Attorney, Agent, or Firm* — Daniel Boudwin; Global Intellectual Property Agency LLC

(57) ABSTRACT

Disclosed is a golf performance tracking and mapping device that utilizes a handheld, portable device having an optical scanner for reading waypoints along a course map, cataloging strokes, distances and further for suggesting and cataloging club choices throughout a round. The data gathered during the round is utilized to create measurable data that can be utilized to create a portfolio of a specific round for posterity, or further for creating data that can be statistically analyzed for a specific user, wherein club ranges, weaknesses and strengths can be determined over a statistically significant period for performance tracking. The device includes a display and an internal global positioning system for tracking location. It is desired that the present tracking device require minimal user input beyond club scanning prior to subsequent swings.

9 Claims, 3 Drawing Sheets

HANDHELD PERFORMANCE TRACKING AND MAPPING DEVICE UTILIZING AN OPTICAL SCANNER

CROSS REFERENCE TO RELATED APPLICATION

This application claims the benefit of U.S. Provisional Application No. 61/513,252 filed on Jul. 29, 2011, entitled "Course Tracking/Club Performance." The patent application identified above is incorporated/here by reference in its entirety to provide continuity of disclosure.

BACKGROUND OF THE INVENTION

1. Field of the Invention

The present invention relates to golf equipment and tracking devices. More specifically, the present invention pertains to a method and means of cataloging golf strokes using an optical code reader, a location tracking system and mobile handset that allows user input and further connection to a computer for processing user statistics. The statistics can be gathered and displayed after a single round for posterity, or alternatively tracked over a longer time interval for personal performance tracking.

Golf is a game of skill that is enjoyed by users of all ages and skill levels. A successful golf game relies heavily on repetition, consistency and knowledge of one's own skills and abilities while on the course. The ability to choose a correct club for a particular situation, knowing when to "lay-up" or when to cross an extended hazard, and knowing which shot path to take is all critical to attaining a competitive score and preventing unnecessary strokes or penalties. For those avid golfers, competitive golfers and even professionals, tracking performance and determining weaknesses or limitations within one's game is vital information. This information can be used to focus practice regimes on a particular subset of skills or on a specific golf course hole for improvement. The ability to track shots over a specific course, realize proper club selection and where to capitalize or be reserved provides golfers with a means of improving their ability and strategy, and in turn lower their golf score handicap.

It is understood that a variety of golf equipment currently exists for determining distances from a user to an intended target, for tracking environmental conditions, and further for tracking one's position and that of one's ball position on a course for real-time analysis and for subsequent statistical analysis activities. These devices generally include distance measuring means or global positioning systems that utilize a keyboard or further user input for tracking certain parameters during play. Most of these require considerable user interaction, including requiring the user to manually input a club choice, stroke distances or further require fiddling with multiple tools for tracking a user's round and overall score. This can quickly become tiring, distracting and inconvenient for the user, and further bothersome for those waiting for the user to clear a hole before commencing their own tee shot.

The present invention is intended to reduce user interaction during game play and improve expediency with which user performance is input in the system, whereby an optical reader and mobile processing device attaches to the user's belt for automatically inputting user variables and calculating output parameters. The position of the user is tracked through global positioning system interaction, while the golfer utilizes the optical reader to establish a waypoint (shot location) and to log in a chosen club without requiring manual input. Subsequent shots are cataloged based on the chosen club and the actual ball location versus the suggested path through the hole is tracked. Adjustment of the course waypoints is conducted real-time based on user input, and suggested club choices are provided to the user. It is desired that the present system be utilized for individual performance tracking or for use by a golf course establishment. When borrowed from an establishment, a single user or plurality of user's may have their golf round analyzed and cataloged for posterity purposes, or alternatively a user may utilize his or her own device for tracking performance overall many rounds to build meaningful statistical data and thus track personal performance. A further use involves tracking a golf team during an outing, where coaches may see each team member's performance and provide feedback or training specific to an individual competitor's needs. It is desired to provide such a tool with minimal distraction to the user during a round, and further require minimal interaction or input outside of reading in a club for each successive stroke after establishing the initiation of a new round or hole.

2. Description of the Prior Art

Devices have been disclosed in the prior art that relate to golf performance tracking and course mapping devices. These include devices that have been patented and published in patent application publications, and generally relate to global positioning systems and handheld devices that require considerable user input after each stroke. The forgoing is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 4,815,020 to Cormier discloses an apparatus and method of computing a distance to a golf green and for selecting an appropriate club therefor while on a golf course. A computer storage device stores distances from a previous round using a selected club, along with updated information with every subsequent stroke for each swing, which is utilized to suggest a club to the user for a given shot. The device of the present invention involves a means of measuring wheel rotation of a wheeled golf bag, along with angular detecting device, which are utilized to determine stroke distance and direction for a given shot. This information is stored, along with the club utilized in the particular shot, as a means of generating statistical data that provides the user with a means of properly selecting a golf club for a subsequent shot based on his or her known distances for specific clubs. The Cormier device is one that is utilized for club selection, as opposed to generating metrics that chart user performance over a round of golf or several rounds. The Cormier device further does not contemplate the bar code scanning and GPS features of the present invention that are utilized for mapping of each shot.

U.S. Pat. No. 5,507,485 to Fisher is another such device that discloses a portable computer that facilitates keeping score and tracking shot locations during a round of golf, as well as a means to track weather and suggest clubs for a specific shot. The device utilizes a global positioning system signal and a display screen for displaying the course and weather. The display screen is useful for showing the user three different views for each golf hole, including the entirety of the hole, the approach to the green associated with the hole, and finally the green itself with a representation of the hole. The device can be utilized to track different games, wagers for a specific hole or game, and finally for use in tracking performance over a defined period, wherein the device "learns" the user's abilities for suggesting a club for a specific shot. While disclosing a course and performance tracking golf device, the Fisher device utilizes the onboard computer, global positioning system and user input to track all parameters. The present invention provides a bar code scanning device that facilitates tracking of each shot and a specific club for each shot. This reduces demands on the golfer, and further reduces errors during the tracking process.

U.S. Pat. No. 4,910,677 to Remedio discloses a mobile means of recording golf scores, wherein a plurality of mobile units are attachable to a master computer for transfer of date therebetween. The mobile modules provide a display screen of the golf course layout and a means of user input for each shot. A keyboard is utilized to enter strokes, wherein the device provides an automated scorekeeper and means of mapping a shot onto a course layout. The Remedio device therefore provides a means for a golfer or plurality of golfers to digitally save their strokes during a round of golf, wherein the stroke count and location can be manually recorded. The present invention advances this type of device to one that utilizes a scanner and barcode for each club, a means of location tracking and a computing system that can track strokes, provide input for suggested clubs for successive shots, and further a means to track performance over a round or several rounds.

U.S. Pat. No. 6,263,279 to Bianco describes a portable distance tracking system for use with a golf course, wherein a mobile interface unit derives position signals from an external source and plots them onto a stored digitized map. A user interface allows the user to input scores and commands, while further receiving information from the device with respect to distance and club choice. Similar to the Remedio device, the Bianco device discloses a tracking device requiring user input, which can lead to noncompliance from hole to hole if the user forgets to mark a ball location through manual input. The present invention is one that facilitates rapid marking of a ball location for later tracking and for developing performance metrics.

U.S. Pat. No. 5,245,537 to Barber discloses a golf distance tracking, club selection and player performance statistics tracking device having a portable measuring means. The measuring means includes a microprocessor, keypad input and a display output. The measuring means is connectable to a non-portable computer that is used to track performance and to communicate updated course and player information on the portable device. A record of clubs utilized, distance achieved and player waypoints are tracked as the user inputs data and accelerometers measure variables during play. In use, the device is an aid for a golfer choosing an appropriate club and preventing the user from over-striking an insufficient club to compensate for a distance. The Barber device, however, has similar failings as the aforementioned devices, wherein input is mostly manual and no means of automatically logging a club or tracking a strike location is provided.

Finally, U.S. Published Patent Application Publication No. 2002/0177494 to Kersten discloses an electronic hand-held golf club selection device having a series of buttons showing the different golf club choices. Upon striking the ball with a specific club, the distance is input into the device for the compilation of data over successive rounds of play. For each golf club, the average distance is calculated and displayed for that club, wherein the user may realize his or her true distance per club and choose effectively for a given stroke distance from a target. This device fails to provide a means of automatically generating distance data after a shot, and relies on third party measuring means and user input thereafter. This places considerable burden on the user, as he or she is required to utilize multiple tools for calculating an average distance. The present invention calculates an average distance, and further provides a means of tracking each shot through minimal user interaction during game play.

The present invention provides a minimal input, optically scanning device that is used to record club choices, track location and therefore track user statistics and overall performance. The device is deployable by independent users or teams, or further by a golf course for memorializing a golf round for special occasions. It is submitted that the present invention is substantially divergent in design elements from the prior art, and consequently it is clear that there is a need in the art for an improvement to existing golf performance tracking and mapping devices. In this regard the instant invention substantially fulfills these needs.

SUMMARY OF THE INVENTION

In view of the foregoing disadvantages inherent in the known types of golf performance tracking and mapping devices now present in the prior art, the present invention provides a new club scanning and location tracking device wherein the same can be utilized for providing convenience for the user when tracking location and personal performance using a device that requires minimal user input after each stroke.

It is therefore an object of the present invention to provide a new and improved golf performance tracking and mapping device that has all of the advantages of the prior art and none of the disadvantages.

It is another object of the present invention to provide a golf performance tracking and mapping device that utilizes optical scanning technology to eliminate the need for a user to manually input club choice or course waypoints after each successive stroke.

Another object of the present invention is to provide a golf performance tracking and mapping device that maps the course, provides user, pin and tee locations, and the most efficient path to the pin using a plurality of waypoints calculated based on user statistical data and course layout.

Yet another object of the present invention is to provide a golf performance tracking and mapping device that catalogs distances for each club for use tracking and analyzing player performance with particular clubs and their associated distances.

Another object of the present invention is to provide a golf performance tracking and mapping device that provides a suggested club for each shot based on calculated distances, the course layout and the user's tracked abilities.

A final object of the present invention is to provide a golf performance tracking and mapping device that can be deployed by a single user or team of users for performance tracking, or further by a course for recording round performance for posterity and memorializing purposes.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

Figure 3A:
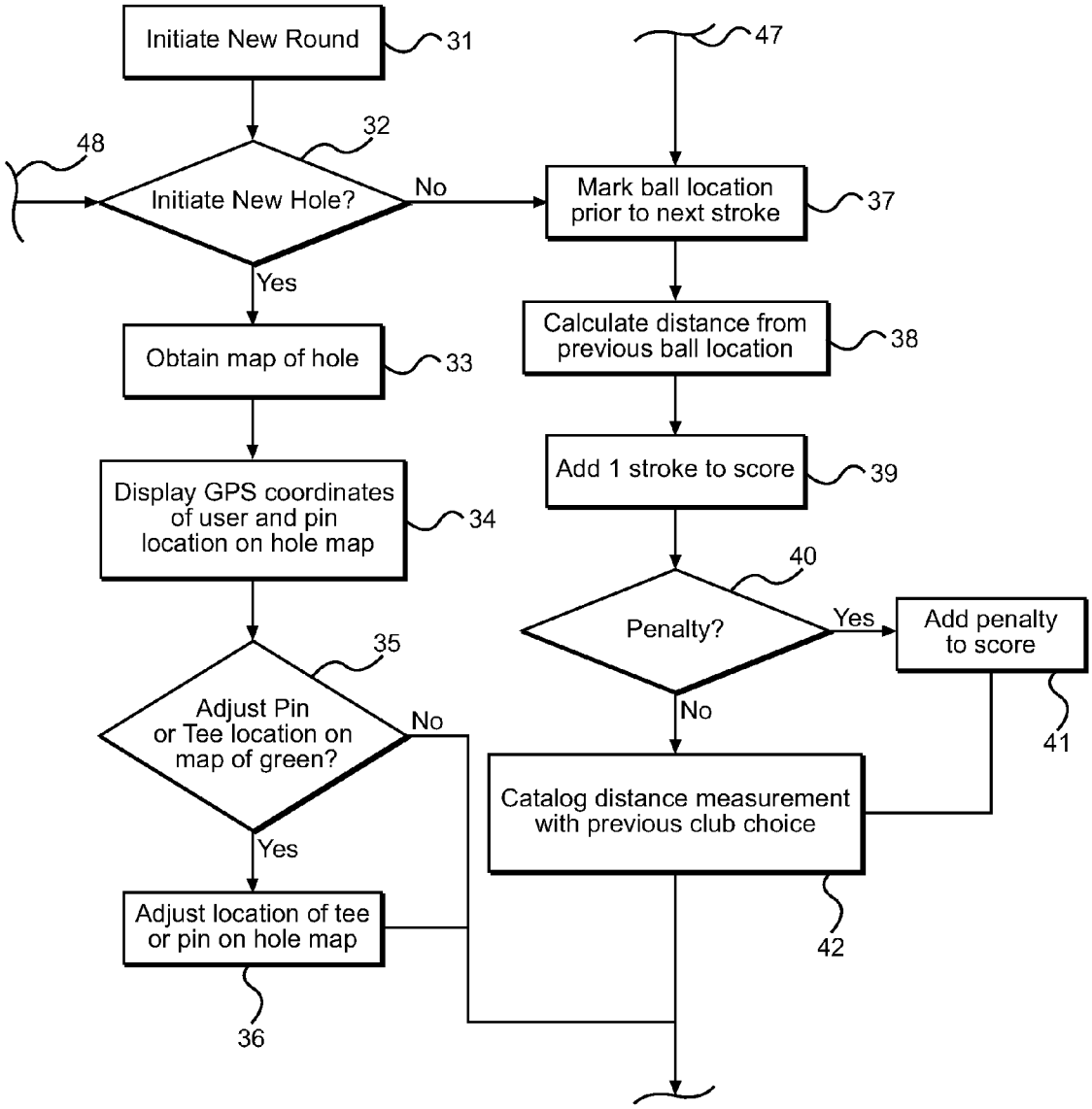

FIG. 3*a* shows a flow diagram of the present device and method.

Figure 3B:
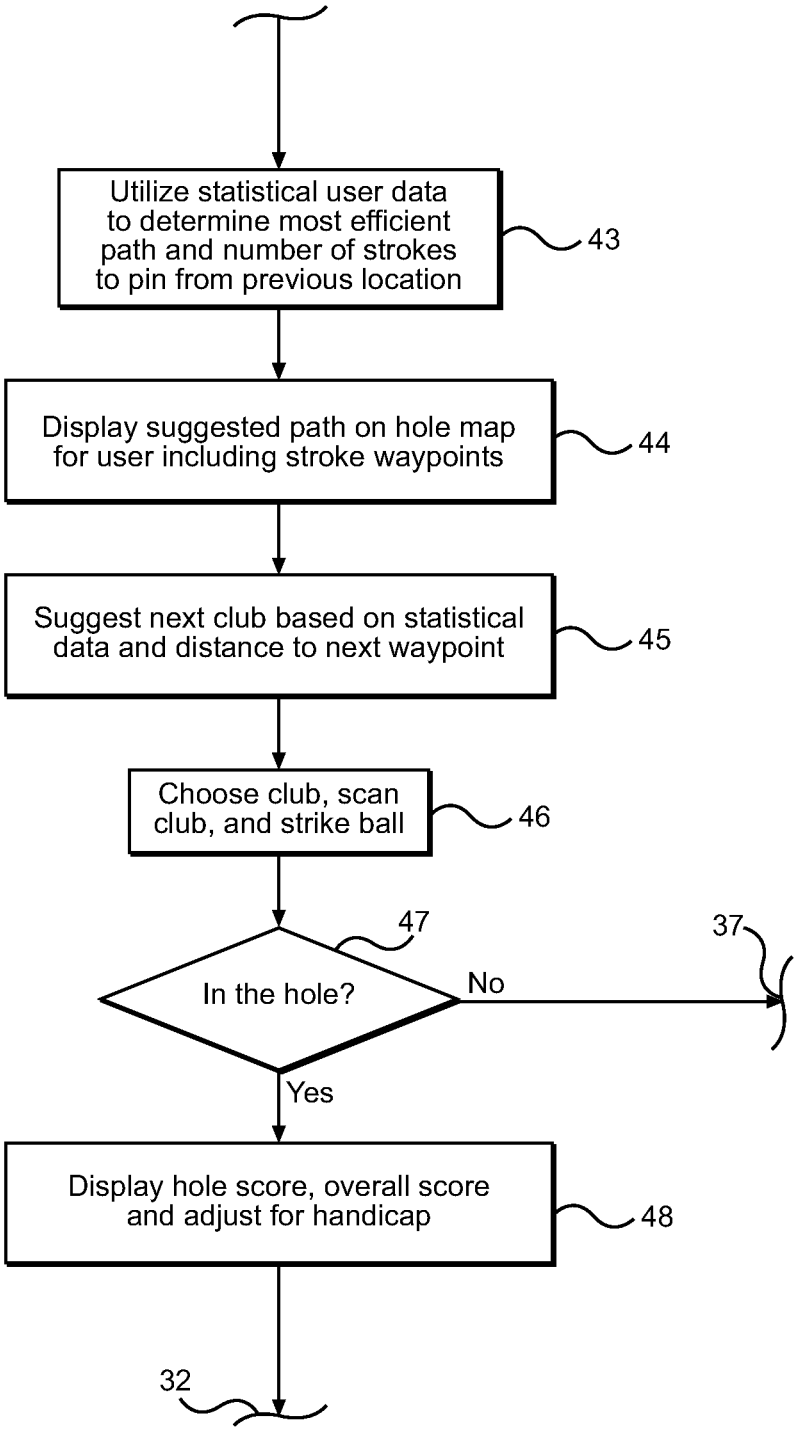

FIG. 3*b* shows a continuation of the flow diagram of the present device and method.

DETAILED DESCRIPTION OF THE INVENTION

Reference is made herein to the attached drawings. Like reference numerals are used throughout the drawings to depict like or similar elements of the golf performance tracking and mapping device. For the purposes of presenting a brief and clear description of the present invention, the preferred embodiment will be discussed as used for tracking personal performance and mapping out each hole for the user utilizing optical scanning technology and complimentary codes on each golf club for a minimally intrusive means of club cataloging and performance tracking. The figures are intended for representative purposes only and should not be considered to be limiting in any respect.

Figure 1:
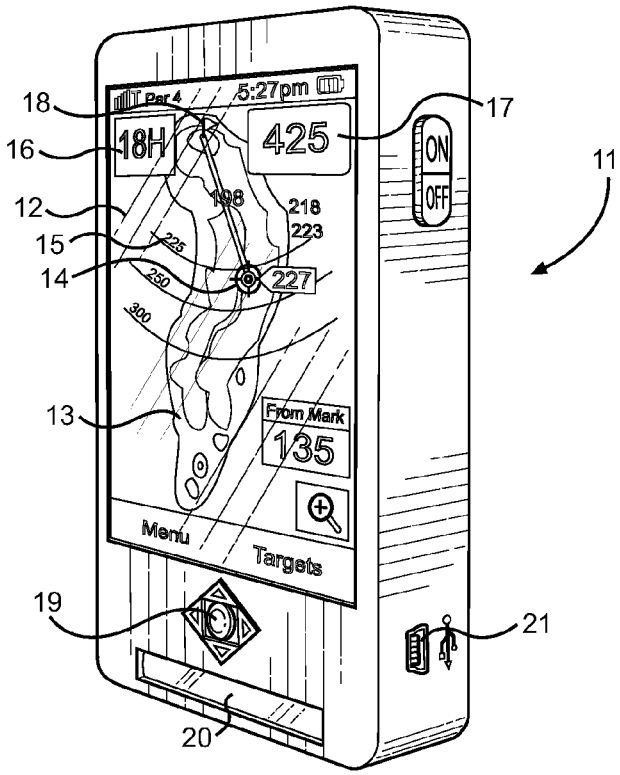
FIG. 1 shows a perspective view of the present handheld device utilized as a means of processing club choices, displaying score and course information, and further for performing calculations that are utilized for club choice and waypoint suggestions.

Referring now to FIG. 1, there is shown a perspective view of the apparatus of the present invention, wherein a handheld and portable 11 tracking device is provided for relaying information to the user, transferring data to a non-portable computer for analysis, for tracking user location and further for scanning the user's club with each stroke. It is desired that the device be comprised of minimal size to reduce interference with the user during his or her stroke, and further promoting the user's willingness to connect the device to his or her person during the round. Direct connection to the user provides the most accurate measurement of the user's location on the course, as opposed to locating the device on a golf cart or bag that is not directly over the ball location. The device itself comprises a housing having a display screen 12, an optical scanning interface 20, user input controls 19 and a means of charging and transferring data 21 to and from the device between rounds. Within the housing is a global positioning system (GPS) transponder, a microprocessor, a battery power source and electronics for operating the display and electrical features of the device.

The display 12 is one that is adapted to readily relay information to the user on the golf course prior to setting up for a shot, whereby the course layout 13 is shown, along with the location of the user 14, the pin 18 and the tee, distances 12 from the user to the next desired or calculated waypoint, as well as course information 16, 17 and suggested club choice for the next stroke are readily provided to the user for each stroke. Player score is calculated, while the user is able to adapt the display to interrogate the map or adjust the desired path to the pin using the user controls 19 as input. The global positioning system provides a means to show the course map and pertinent user and course information on the screen to allow the user to choose a selected club and the most efficient path to the pin, while the device calculates a suggested club for a user based on his or her past performance with specific clubs and distances required to the next waypoint.

Figure 2:
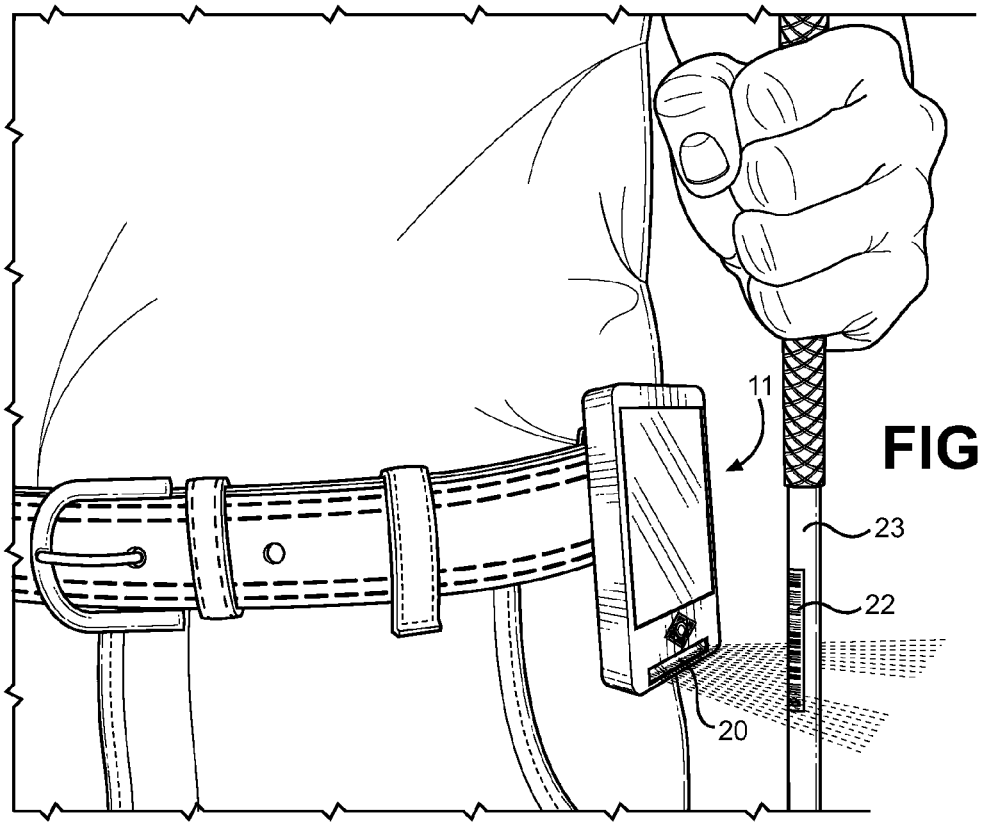
FIG. 2 shows the present device in a working position, scanning a particular club prior to its use.

Referring now to FIG. 2, there is shown the device in a working state, recording a chosen club prior to a subsequent golf stroke. The device includes an optical scanner 20, such as barcode scanner or similar optical scanning technology, wherein each user club includes a specific bar code 22 that is read by the device prior to each swing. In this way, the club of choice is recorded for each swing and the ball location is marked, allowing shot distance to be calculated based on the previous ball location. In operation, the club 23 is recorded in close proximity to the ball location, wherein the location is recorded in the device and on the course map to show the results of the last shot, record the distance traveled and catalog the distance against the previously scanned club. This operation is conducted for each swing, however the tee shot is chosen as a "first shot" and thus distance from a previous swing is not relevant and calculated. As mentioned, the device 11 is ideally located on the user's belt or person such that rapid scanning is achieved with minimal interference with the user's normal approach, rhythm and pace through the course. The user is capable of manipulating the screen and various user options, however it is not desired that the user be required to do such activities with each stroke, but rather disclose an optical scanner that automatically records club choice, location and distances for analytical and information purposes.

Referring now to FIG. 3*a* and FIG. 3*b*, there is shown a flow diagram of an embodiment of the device operation, wherein an optical scanner tool is utilized to facilitate score recording, distance measuring, club suggestions and performance tracking for the user while eliminating the need for considerable user input after each stroke. Prior to the first swing of the round, the scanner device is initialized 31 to signify a new round is commencing. The course map may be loaded such that the individual holes can be viewed, distances to the pin and intermediate waypoints may be visualized prior to teeing-off. Upon approaching the first hole and subsequent holes thereafter, a new hole is initiated 32, wherein the specific hole map is shown fully 33, along with GPS location of the user, the pin and the tee box 34 on the map. The device creates a sample path from the tee box to the pin using the most efficient path calculated, while considering the user's specific distance capabilities, the overall hole distance and the hazards along the hole. The user may adjust the pin and tee locations 35 on the hole to account for different tee box locations and if the pin is in a different location along the green than is listed on the map (front/center/back based on flag color or pin movement due to green repair). The user is able to manipulate the map using the direction pad input on the device, wherein options are chosen and the pin and tee can be manually placed if desired. The user interface may take any form wherein the user is able to make selections on the display screen during required periods; this includes a direction pad with push-button input, or any further suitable input that is preferably minimalistic and efficient.

Prior to teeing off, and as visualized in the flow chart of FIG. 3*b* after initialization of a new hole, the device calculates the most efficient path from the tee box location to the pin using statistical data generated over time from the user 43. If insufficient data is available, a general pathway is displayed 44 based on anticipated club distances and a par score for the hole. Based on the calculated first waypoint and its distance from the tee, the device suggests a club for the user to utilize 45 to achieve the distance required. Once the club is retrieved and during setup over the ball, the user scans the club using the device optical scanner and a visual code on the club shaft, wherein the club choice is cataloged for later analysis. After the swing, subsequent shot locations are cataloged using the same setup process: scanning the club over the ball location, until the ball is in the hole 47 and the hole score can be tabulated 48.

After locating the user's ball after a stroke, the location can be marked 37 on the map by a single user input or by scanning the next club using the optical scanner. From this location, the GPS coordinates are utilized to calculate the travel distance of the previous shot 38 and to add a stroke to the user's overall score 39. If the user has gone out of bounds or is otherwise subject to a penalty 40, the penalty can be chosen and input prior to the next swing. The distance traveled by the previous shot and the chosen club are cataloged for future analysis 42, whereafter the waypoints are updated on the map 43, 44 before a club suggestion is made 45 and the user scans his or her next club 46. In this way, the user inputs club choices using only a scanning tool, while the location of a shot can be selected using the input buttons or the scanning of a subsequent club (in the case the user does not manually input the ball location. The latter set of steps reduces user input in the case the user is not vigilant with marking the ball location. If the location is not marked, the next scanned club is utilized as the default marker and thus the steps of updating the map, club choice and score occur automatically thereafter as if the ball was properly marked in the manual process.

The game of golf is a very popular sport and pastime for many individuals. However, the game of golf requires knowledge of scoring, club choice and personal performance capabilities in order to master. Tracking user performance statistics while playing the game or round after round can be difficult if conducted manually, as the distance to the hole and distance of each shot is not known to a high level of accuracy. Additionally, when golfers choose a specific club, they typically do not base this information on previously collected data, but rather on instinct or general distances for a chosen club. Manually tracking performance data by hand and tabulating it between rounds is tedious, time consuming, and can be distracting from actually playing and enjoying the game. The present invention pertains to a means of scanning club choices and utilizing a GPS map to track distance measurements for each club, as well as a means to calculate real user statistics over one or several rounds of play.

The present invention is a portable electronic tracking device and method of use that can be worn on a golfer's belt, wherein the device includes an optical scanning technology to read a code affixed to the user's golf clubs. Specific codes denote a specific club choice, wherein that club and the subsequent distance of the anticipated shot versus the actually performed shot distance is calculated to generate user performance statistics and measurable data. It is submitted that a competitive user, a team of users or casual user may utilize this device for tracking each shot and displaying performance after each hole and after each round. It is further submitted that a golf course establishment may also utilize this technology to memorializing a round of golf for a user or set of users. This may be desirable during special events or even during formal competitions for analysis purposes. The device is equipped with the ability to read an optical code label that can be affixed to the club shaft. Before the golfer uses the club, the user simply scans the club code and the device can track various performance scores with much more input required from the user. At the same time, course information is displayed for user interrogation and inspection.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf performance tracking and mapping device, comprising:

a handheld device having a display screen, an optical scanner, a user input, and a global positioning system locating means;

said locating means being utilized to display course information, a hole map and user location;

said optical scanner adapted to scan a unique optical code on a golf club for cataloging a club choice prior to a swing;

wherein said user input is adapted to allow a user to mark a ball location after a stroke, and wherein a distance measurement from a previous ball location is calculated and cataloged with the previous club choice;

wherein said handheld device displays a suggested path for a user to hit a golf ball from the user towards a hole pin location that is updated with each stroke.

2. The device of claim 1, wherein said user input provides a means for choosing options on said display and for interrogating said display information.

3. The device of claim 1, wherein said suggested path utilizes statistics from previous rounds for said user, utilizing average distances for specific clubs to choose an efficient path suited for said user.

4. The device of claim 1, wherein said handheld device displays a suggested club for the user to utilize.

5. The device of claim 4, wherein said handheld device utilizes statistics from previous rounds for said user, utilizing average distances for specific clubs to choose an efficient golf club suited for said user.

6. A method of tracking golf performance and mapping a golf hole, comprising the steps of:

carrying a handheld device that includes a global positioning system locating means, an optical scanner and a display screen through a golf round;

scanning a golf club-specifically optical code using said optical scanner to catalog a chosen golf club prior to a stroke;

marking a ball location after said stroke to calculate distance and catalog said distance with said club to generate user statistics for each club;

displaying a calculated path on which to hit a golf ball from said user position to a hole on said handheld device.

7. The method of claim 6, further comprising the steps of displaying course and hole information on said handheld device.

8. The method of claim 6, wherein said calculated path is determined based upon said user statistics for each club generated by said handheld device.

9. The method of claim 6, further comprising the step of displaying a suggested club for the user to utilize based upon said statistics generated for each club.

* * * * *